US007731450B2

(12) United States Patent
Congdon et al.

(10) Patent No.: US 7,731,450 B2
(45) Date of Patent: Jun. 8, 2010

(54) METHOD OF OPERATING A COMPACTOR MACHINE VIA PATH PLANNING BASED ON COMPACTION STATE DATA AND MAPPING INFORMATION

(75) Inventors: Thomas M. Congdon, Dunlap, IL (US); Paul T. Corcoran, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 870 days.

(21) Appl. No.: 11/517,065

(22) Filed: Sep. 7, 2006

(65) Prior Publication Data

US 2008/0063473 A1 Mar. 13, 2008

(51) Int. Cl.
*E01C 23/01* (2006.01)

(52) U.S. Cl. ..... 404/84.5; 701/50

(58) Field of Classification Search ..... 404/84.1, 404/84.5; 701/50
See application file for complete search history.

(56) References Cited

U.S. PATENT DOCUMENTS 4,149,253 A * 4/1979 Paar et al. ..... 701/50
4,216,838 A * 8/1980 Degraeve et al. ..... 180/14.1
5,294,210 A * 3/1994 Lemelson ..... 404/84.1
5,471,391 A 11/1995 Gudat et al.
5,493,494 A 2/1996 Henderson
5,727,900 A 3/1998 Sandstrom
5,764,511 A * 6/1998 Henderson ..... 700/66
5,801,967 A * 9/1998 Henderson et al. ..... 702/156
5,935,192 A * 8/1999 Henderson et al. ..... 701/208
5,942,679 A 8/1999 Sandstrom
5,991,687 A * 11/1999 Hale et al. ..... 701/207
5,995,895 A * 11/1999 Watt et al. ..... 701/50
6,076,030 A * 6/2000 Rowe ..... 701/50
6,085,130 A 7/2000 Brandt et al.
6,088,644 A 7/2000 Brandt et al.
6,122,601 A 9/2000 Swanson et al.
6,188,942 B1 2/2001 Corcoran et al.
6,431,790 B1 * 8/2002 Anderegg et al. ..... 404/75
6,460,006 B1 10/2002 Corcoran
6,701,239 B2 * 3/2004 Keefer ..... 701/50
6,741,949 B2 5/2004 Corcoran et al.

(Continued)

OTHER PUBLICATIONS

Gesellschaft Fur Geotechnik GmbH; Compactometer Dokumentations System; pp. 440-452, Published prior to Aug. 31, 1991.

(Continued)

*Primary Examiner*—Gary S Hartmann
(74) *Attorney, Agent, or Firm*—Liell, McNeil & Harper

(57) ABSTRACT

A method of operating a compactor machine includes moving the compacting machine within a work area and determining a compaction response disconformity exists between at least two regions of the work area. The method includes generating a compactor navigation signal responsive to the compaction response disconformity. A method of compacting a work area may include determining a work material compaction response associated with at least one region of the work area is aberrant, and maneuvering the compactor machine within the work area responsive to a signal associated with the aberrant compaction response. A system for compacting a work area includes a compactor machine and an electronic controller configured via a compactor maneuvering control algorithm to detect an aberrant work material compaction response in a region of the work area and responsively generate a compactor navigation signal.

18 Claims, 4 Drawing Sheets

U.S. PATENT DOCUMENTS

| | | | | |
|---|---|---|---|---|
| 6,751,540 | B2 | 6/2004 | Keefer et al. | |
| 6,752,567 | B2 * | 6/2004 | Miyamoto et al. | 404/84.1 |
| 6,845,311 | B1 * | 1/2005 | Stratton et al. | 701/50 |
| 6,880,643 | B1 * | 4/2005 | Zimmerman et al. | 172/4.5 |
| 6,973,821 | B2 | 12/2005 | Corcoran | |
| 7,226,239 | B2 * | 6/2007 | Stridiron et al. | 404/84.1 |
| 7,428,455 | B2 * | 9/2008 | Corcoran | 701/50 |
| 7,575,395 | B2 * | 8/2009 | Stridiron et al. | 404/84.1 |
| 7,591,608 | B2 * | 9/2009 | Hall et al. | 404/84.1 |
| 2005/0158129 | A1 | 7/2005 | Chi et al. | |
| 2007/0025815 | A1 * | 2/2007 | Sick | 404/84.1 |

OTHER PUBLICATIONS

H. Thurner, and A. Sandstrom;Continuous Compaction Control,CCC;European Workshop Compaction of Soils and Granular Materials, Paris, May 18, 2000, pp. 237-246;Stockholm, Sweden.

* cited by examiner

METHOD OF OPERATING A COMPACTOR MACHINE VIA PATH PLANNING BASED ON COMPACTION STATE DATA AND MAPPING INFORMATION

TECHNICAL FIELD

The present disclosure relates generally to methods of operating a compactor machine to compact a work material in a work area, and relates more particularly to such a method wherein work material compaction response and compactor position information are used to determine a desired travel path for maneuvering a compactor machine within the work area.

BACKGROUND

Many construction, road building and related endeavors employ compactor machines to compact work material such as earth, asphalt, gravel, mixtures, etc. so that the work material will be suitable for an end purpose. Compaction may also be used to reduce the volume of work material, as in the case of materials such as landfill trash. A traditional approach to compacting work material in a given work area is to pass a compactor machine uniformly across the work area, using operator judgment, ground-based visual markers, or electronic positioning systems to indicate the progress of compacting the work material. Such conventional strategies typically assume that uniform coverage of a work area with a compactor machine will result in uniform compaction of the work material. Many sophisticated compacting machines, systems and operating methods have been developed over the years in an attempt to optimize operating efficiency and avoid unnecessary travel of the compactor machine across regions already covered. Despite such improvements, operating compacting machinery remains an often expensive, unpredictable and labor-intensive process.

Approaches relying upon operator judgment and perception, and even visual cues such as markers placed about the work area, have the potential for human error as well as requiring substantial operator or technician preparation time. It is common for regions to be covered by a compactor machine more or fewer times than necessary in conventional approaches, wasting time and energy, and ultimately limiting work progress. As alluded to above, in more recent years relatively sophisticated compacting systems have been developed which utilize position signals from a source such as global positioning system satellites or ground-based laser positioning systems. Certain of these systems have provided substantial improvements over traditional approaches to compactor machine guidance.

Even the most advanced systems currently available, however, generally assume that compaction progress is closely correlated with compactor coverage. In other words, while more sophisticated electronic control and positioning systems can provide for more accurate information regarding the position of a compactor and, hence, its coverage of a given work area, they do not address irregularities, or general unpredictability in the work material's compaction response. Because different regions of a work area may exhibit varying work material compaction responses, there are limitations to uniform coverage approaches, regardless of the extent of positioning accuracy and precision.

In the context of asphalt compaction, variations in compaction progress among uniformly covered regions of a work area has been recognized by Sandstrom in U.S. Pat. No. 5,942,679. In Sandstrom's approach, a compactor machine is equipped with a variety of sensors, including temperature, compactor velocity, path changes and static mode versus vibratory mode detectors. A microprocessor in Sandstrom determines a position of the compactor machine in relation to a paving machine, and hence can associate certain of the sensed operating parameters with particular regions of an area being paved.

Sandstrom purports to integrate the sensed parameters into a compaction index number representative of a total amount of compacting work the compacting machine has performed in a particular area. Although Sandstrom may have provided a useful insight, the approach does little, if anything, to guide decision-making based on the data. In other words, while Sandstrom may be useful in gathering data, Sandstrom does not teach acting upon the data apart from the conclusions of a human operator or manager. Moreover, Sandstrom does not recognize certain characteristics of work material compaction response that may be useful in planning subsequent compactor work.

As discussed above, there have been various improvements in guiding the operation of compacting machinery in recent years. In addition, certain insights have been made which relate to varying responses of work material subjected to attempted compaction. Nevertheless, there remains room for improvement.

The present disclosure is directed to one or more of the problems or shortcomings set forth above.

SUMMARY OF THE DISCLOSURE

In one aspect, the present disclosure provides a method of operating a compactor machine including moving the compactor machine within a work area. The method further includes determining a work material compaction response disconformity exists between at least two regions of the work area, and generating a compactor navigation signal responsive to the compaction response disconformity.

In another aspect, the present disclosure provides a method of compacting a work area with a compactor machine. The method includes sensing values indicative of a work material compaction response in a first region of the work area, and sensing values indicative of a work material compaction response in at least one other region of the work area. The method further includes determining a work material compaction response in the at least one other region of the work area is an aberrant compaction response, and maneuvering the compactor within the work area responsive to a signal associated with the aberrant compaction response.

In still another aspect, the present disclosure provides a system for compacting a work area including a compactor machine and at least one sensor configured to sense values indicative of a work material compaction response within a work area. The system further includes an electronic controller coupled with the at least one sensor and configured via a compactor maneuvering control algorithm to detect an aberrant work material compaction response in a region of the work area and generate a compactor navigation signal responsive thereto.

DETAILED DESCRIPTION

Figure 1:
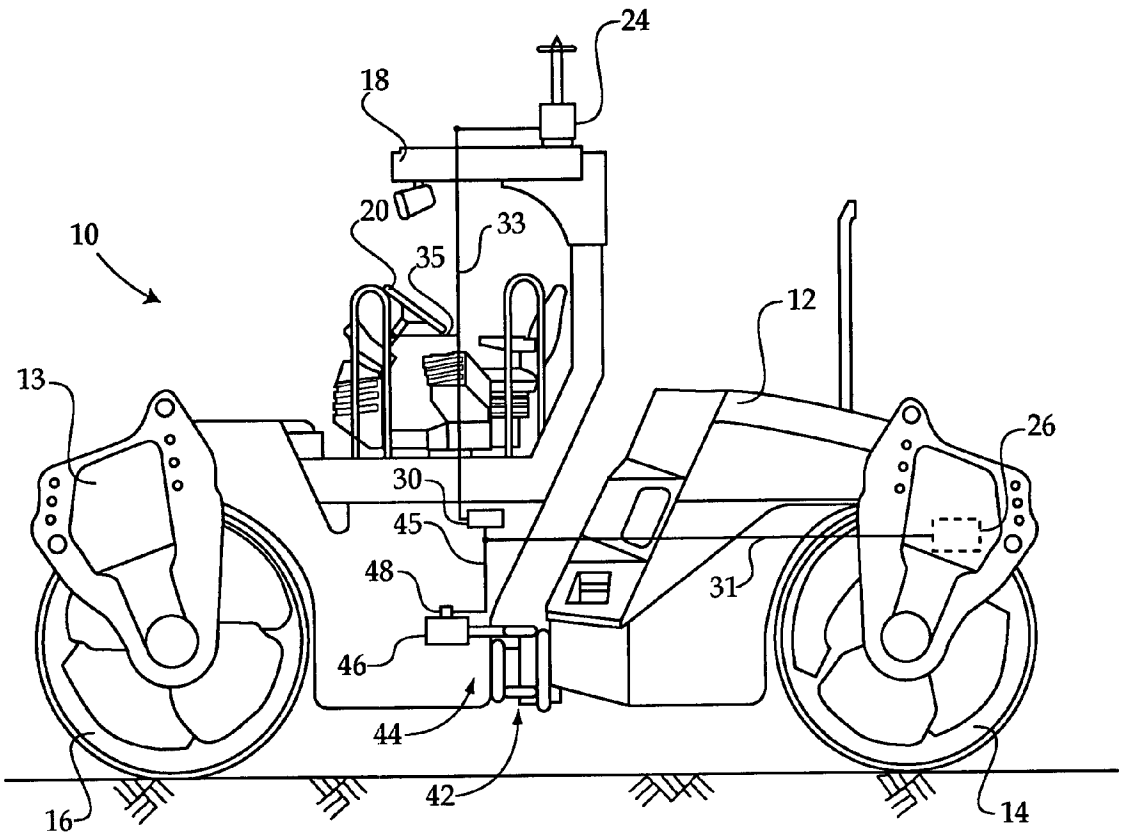
FIG. 1 is a side diagrammatic view of a compactor machine according to one embodiment of the present disclosure.

Referring to FIG. 1, there is shown a compactor machine 10 including a frame having first and second frame units 12 and 13. Compactor 10 may further include an operator cabin 18 having therein an operator input device 20 such as a steering wheel or similar control device. A position signal receiver 24 may be mounted on one of frame units 12 and 13, which is configured to receive position signals from a signal transmitter such as a global positioning satellite(s), or another system such as a ground based laser positioning system. Compactor 10 may further include an electronic controller 30 configured to control various aspects of compactor operation, as described herein. Compactor 10 may also include at least one compaction state sensor 26. Electronic controller 30 may be configured to utilize mapping or position information received via receiver 24 in conjunction with work material compaction response data input to electronic controller 30 from sensor 26 to navigate within a work area in an optimally efficient manner. In accordance with the present disclosure, compacting work may be directed within a work area to regions where it is needed, and away from regions where it is not needed or not effective, as described herein.

Sensor 26 may be coupled with electronic controller 30 via a communication line 31, whereas operator input device 20 may connect with electronic controller 30 via another communication line 35, and receiver 24 may connect with electronic controller 30 via yet another communication line 33. Compactor 10 may include an articulation joint 42 coupling first and second frame units 12 and 13, and may further include a steering system 44 such as an articulation steering system configured to steer compactor 10 during operation. To this end, input device 20, or an electronic steering control device such as electronic controller 30, may be configured to communicate steering control signals via yet another communication line 45 to steering system 44. In one specific embodiment, steering system 44 may include one or more steering actuators 46, such as hydraulic cylinders, having one ore more control valves 48 coupled therewith. Steering control signals may thus be used to adjust a position, speed, direction, etc. of actuator 46 to control travel direction of compactor. Compactor 10 may also be equipped with an electronically and/or operator controlled throttle (not shown) and possibly other manual or electronically controlled features such as a vibratory apparatus (not shown) associated with one or both of first and second compacting drums 14 and 16.

Compactor 10 is shown in the context of a machine having dual rotating, smooth drums 14 and 16, however, the present disclosure is not thereby limited, and other types of compacting machines may be suitable for use in the context of the present disclosure. In non-articulated versions of compactor 10, for instance, a different type of steering system than articulation steering system 44 might be used. Further, belted compactors or compactors having a single rotating compacting unit, or more than two compacting units, are contemplated herein. Rather than a self-propelled compactor machine as shown, compactor 10 might be a tow-behind or pushed unit configured to couple with a tractor, for example. A landfill compactor, a padfoot or sheepsfoot style compactor or still other compactor types such as vibratory compactors may also be fairly considered to fall within the scope of the present disclosure.

Sensor 26 may be configured to sense values indicative of a compaction response of work material in a work area within which compactor 10 is moved. In particular, sensor 26 may comprise a single sensor, or a set of sensors, configured to sense a relative rolling resistance of compactor 10 as it moves across a work area. Sensor 26 may be configured to output sensed values to electronic controller 30 which are indicative of a work material compaction response via communication line 31. It should be appreciated that the term "work material" should be broadly construed herein, as the teachings of the present disclosure are considered to be generally applicable to most, if not all work material types. Moreover, descriptions herein of "soil" or "earth" should not be construed in a limiting sense. Soil, sand, gravel, concrete, asphalt, landfill trash, mixtures including any of the foregoing, etc., are all contemplated as work materials suitable for use in worksite preparation via the methods and systems described herein.

Sensed rolling resistance may indicate a relative compaction state of work material across which compactor 10 is moved. Successive or periodic measurements, either direct or indirect, of relative compaction state or another work material compaction parameter may be understood as defining a compaction response of the work material as compactor 10 is passed across a work area or region thereof. Relative compaction state tends to relate to load bearing capacity of the compacted work material which will often, although not necessarily, be the parameter of most interest to operators and/or project managers. In some jurisdictions, compaction state is judged by a density measurement, for example, and it should thus be appreciated that the compaction state and sensed parameter values are not limited to the embodiments specifically described herein. Sensor 26 may thus be any sensor type, or sensor group, which is configured to sense some parameter value that is indicative of, either directly or indirectly, a compaction response of work material in a work area, as described herein. Positioning of sensor 26 on compactor 10 will provide one practical implementation strategy, such that compaction response may be determined onboard compactor 10 during operation. The present disclosure is not limited to such a strategy, however, and sensor 26 might comprise sensor(s) which are separate from compactor 10.

Returning to an embodiment including sensing of relative rolling resistance, as compactor 10 is moved across a region of a work area, the energy necessary to propel compactor 10 is generally inversely proportional to the relative degree of load bearing capacity of the region of the work area across which compactor 10 is passed. This phenomenon is similar to the familiar relationship between the relatively greater effort needed to roll a wheel across a relatively soft substrate like sand, as compared to a relatively harder substrate like concrete. As the substrate becomes relatively stiffer, less energy is required to move the compactor.

Electronic controller 30 may be configured to record sensed values associated with rolling resistance during each of a plurality of compactor passes over a region of a work area, such that a work material compaction response curve may be determined based on the sensed values. The compaction response curve may comprise a curve fitted to values associated with inputs from sensor 26 via known curve fitting techniques. In one practical implementation strategy, gross driveline energy in compactor 10 may be determined, internal losses of compactor 10 subtracted, and the portion of energy expended that relates to an inclination of the work surface in a particular region of interest also subtracted. The above calculation allows a determination of the net energy expended to compact the work material to a given compaction state, otherwise known as the "net compaction energy." Net compaction energy is indicative of the work material compaction response. A suitable apparatus and method for the aforementioned process of determining the rolling resistance of compactor 10 is taught in U.S. Pat. No. 6,188,942 to Corcoran et al. The above strategy can generate values associated with compaction response for each compactor pass across a region of a work area which, taken together, may define a compaction response curve of the work material. Certain features of the compaction response curve may be further evaluated in controlling compactor 10, as described herein.

It should be appreciated that various other means may be used for directly or indirectly determining net compaction energy imparted to the work material by compactor 10, or some other compaction state parameter of interest. In a hydrostatic drive compactor machine, for example, rolling resistance may be computed based on sensed hydraulic pressure and flow rate to give an indication of the amount of machine energy imparted to the work material. In embodiments where density is monitored, a density sensor mounted on compactor 10, or separate, might be used which utilizes radiation backscatter or some other phenomenon. A suitable commercial source for density meters is Troxler Electronic Laboratories, of Research Triangle Park, North Carolina. Still other parameters such as fuel consumption may be used in determining the net energy required to move compactor 10 across a region of a work area, which in turn will indicate the relative compaction state and ultimately work material compaction response associated with that region. Traditional tests such as walkout tests, measurements of relative rolling radius measurements of the depth of penetration of a tow-behind device, or even a sinkage deformation interaction between compactor 10 and the work material might be used. The present disclosure thus contemplates any compaction state measurement strategy known in the art. Moreover, in certain embodiments sufficient compaction data may be obtained via a single compactor pass across a given region. For instance, elevation data obtained via position signals might be used to determine a relative elevation of compactor 10 and thus indicate compaction progress after one or more passes across a given region.

Position signals received via receiver 24 may also be used to determine a relative position of compactor 10 within a work area. Determination of the relative position of compactor 10 within a work area, and determination of a work material compaction response, by any suitable means, will allow a determination of compaction responses associated with each of a plurality of separate regions of the work area. An association between position information and compaction response information will facilitate selective guiding of compactor 10 within the work area. In particular, regions having a target compaction response, for example regions wherein work material is compacting as desired, as well as regions where additional compaction effort will be futile, can be identified such that wasted effort is avoided. Operating efficiency for compactor 10, and by implication an entire work area, can thereby be substantially improved over known strategies. The present disclosure may be understood as providing a means whereby non-uniform coverage of a work area may be undertaken if desirable, in contrast to earlier uniform coverage approaches.

The above capabilities of compactor 10 may be embodied in a method of operating a compactor machine, in particular to compact a work area. The method may include moving compactor 10 within a work area, for example moving compactor 10 across a first region of a work area via a plurality of compactor passes, and across at least a second region of a work area also via a plurality of compactor passes. During moving compactor 10, values indicative of a work material compaction response associated with the first region may be sensed, for instance, via inputs from sensor 26, as well as values indicative of a work material compaction response associated with the second region. During or subsequent to moving compactor 10 across the respective regions, a work material compaction response for each of the regions may be determined. Association between the sensed values, and thus compaction response, and the location of the respective regions may be achieved via position signal inputs received via receiver 24. The determinations of compaction response and relative position may be carried out by electronic controller 30 or by a remote computer if desired.

The method may further include determining a work material compaction response disconformity exists between at least two regions of the work area such as the first region and the second region, and generating a compactor navigation signal responsive to the compaction response disconformity. As used herein, the term "disconformity" may be understood as a state wherein a compaction response of one region differs from a compaction response of at least one other region within a work area. Thus, a disconformity might be determined between two regions, or among several regions. In one aspect, determining a compaction response disconformity exists may include determining at least one region of the work area is associated with a target compaction response and at least one other region of the work area is associated with an aberrant compaction response. A target compaction response may be understood as a condition wherein work material within a region of the work area is compacting as desired, or alternatively has compacted to a desired compaction state. As described above, target compaction specifications may include a load bearing capacity of the work material, a density or some other compaction state parameter.

Aberrant compaction may be characterized by a condition wherein the work material is not compacting as desired, or some indicia exists that work material compaction will not reach a target compaction state, regardless of the number of times compactor 10 is passed across the subject region. An aberrant compaction response may also exist where an estimated or predicted number of compactor passes necessary to reach target compaction conditions is greater than some predetermined number of passes. Aberrant conditions may include an excess moisture condition, an insufficient moisture condition, an overcompacted condition, an inappropriate lift thickness condition and a generalized unfit condition, or still other conditions. Criteria whereby a compaction response is determined to satisfy one or more of the aberrant conditions of interest may be determined empirically, as further described herein. Further, while in certain embodiments, a compactor navigation signal may be generated responsive to a determined compaction response disconformity, in other embodiments compactor 10 may be maneuvered via a navigation signal that is generated responsive specifically to the determined aberrant compaction response. In other words, it is not necessary in all embodiments that a compaction response disconformity be specifically determined, as compactor 10 might be guided via a navigation signal to simply avoid areas associated with an aberrant compaction response, or to cover areas not associated with an aberrant compaction response.

An aberrant compaction response may be identified by determining a compaction response curve for a particular region, and evaluating a variety of features of the compaction response curve. Such features may include, but are not limited to, a slope of an initial portion of the compaction response curve, a closeness of fit of the compaction response curve relative to the points defining the curve and an asymptotic level of energy associated with a latter portion of the curve. In other instances, aberrant compaction might be indicated by an elevation change after one or more compactor passes that differs from an expected elevation change.

Where slope of an initial portion of the compaction response curve is evaluated, the segment or portion of interest may be that portion defined by at least the first two values sensed by sensor 26. The segment/portion may also include the first three or four sensed values collected after or during three or four compactor passes over a given region. The slope of the initial portion of the compaction response curve may be determined by electronic controller 30 via known linear regression techniques. The slope may also be determined via a map or some other means.

In application, the relative steepness of the described slope may be used to determine whether the work material compaction response of a particular region appears aberrant, in particular whether the slope is different from an expected or permitted slope or slope range. To effect this determination, a compaction suitability range may be determined which corresponds with a suitable slope of an initial segment of the compaction response curve. Determining if the compaction response is or appears aberrant may further include determining if the slope of the initial segment of the compaction response curve is outside of the compaction suitability range, that is, relatively steeper or shallower than the suitability range.

The terms "steeper" and "shallower" are used herein in an illustrative manner only, and are applicable where the compaction response curve is a load bearing capacity, net energy, or other indication of compaction response versus compactor pass number curve. Where density, or a different compaction indication is used, use of the terms "steeper" and "shallower" might be reversed. For example, a particularly wet work material may achieve target density rather quickly but cannot achieve adequate load bearing capacity. Excess moisture content provides a lubricity property that permits consolidation, and removal of air voids rather easily, however the inability of individual particles to become closely bonded prohibits adequate support of a load because of the material's tendency to deform.

If the work material is particularly wet, the initial segment of the compaction response curve may be relatively shallow where the determined compaction parameter is load bearing capacity or net energy, and relatively steep where the determined parameter is density. Conversely, a particularly dry soil may exhibit a rather steep initial segment of the compaction response curve where load bearing capacity or net energy is considered, and be relatively shallow if the evaluated compaction parameter is density. It is nevertheless contemplated that the initial slope of the compaction response curve may be used in determining whether the compaction response appears aberrant regardless of the sensed compaction parameters. The suitability range for the described slope may depend upon the particular work material type, and may be determined empirically. A soil with a high clay content, for example, will certainly exhibit different compaction characteristics than a sandy soil. Thus, the boundaries and breadth of the compaction suitability range for the slope of the initial segment may be different for different work material types.

The described slope behavior for dry soils is believed to be due at least in part to the relative ease of supporting substantial loads where moisture content is low. The absence of significant amounts of water tends to allow greater friction between the soil particles and allows air to be expelled relatively easily. While dry soils do appear to have relatively good load bearing capacity, they tend to be unstable over time, as moisture can penetrate the air voids and change the soil properties. For this reason it will often be desirable to detect an insufficient moisture condition of the work material, despite relatively high load bearing capacity, and account for such conditions in determining whether a region appears aberrant, and hence in determining whether a compaction response disconformity exists.

Therefore, if the slope of the initial segment of the compaction response curve is relatively steeper than the compaction suitability range, in the above example, it may be determined that the work material has an insufficient moisture content and the subject region is aberrant. If the determined compaction response of the subject region differs from that of another region of the work area, a compaction response disconformity may be determined to exist.

It has further been discovered that work material having relatively low particle cohesion may often exhibit a compaction response curve having a relatively shallow initial slope, at least where the compaction response curve is a load bearing capacity versus compactor pass number curve. In other words, aberrant compaction may exist where the slope of the initial segment of the compaction response curve for one region of the work area is relatively shallower than a suitability range for the slope. Such work materials can include aggregates low in fine particles and dry sands, for example. This behavior is believed to be due at least in part to the fact that the individual particles tend to stick to one another less than in wetter or otherwise more cohesive work materials, and hence, are remolded upon successive passes by a compactor. This is particularly apparent when the compaction machine is equipped with sheepsfoot or other tips on the drums, and is less apparent with smooth drum compaction machines. Constant re-manipulation of the particles tends to result in difficulty in increasing the degree to which the work material is compacted. Accordingly, where the slope of the initial segment of the compaction response curve has a slope that is shallower than the compaction suitability range, it may be determined that the work material has an unsuitable degree of cohesion and, accordingly, has an aberrant compaction response for the subject region.

A suitability range for determining aberrant compaction responses via the slope of the initial segment of the compaction response curve may be determined empirically. Test beds may be compacted under varying conditions having, for example, different moisture content or different proportions of aggregates and/or sand. A particular compaction response curve, for example a load bearing capacity versus compactor pass number curve, may then be determined for each set of soil conditions and the slope of an initial segment of the compaction response curves determined. By analyzing the slopes of compaction response curves for work material types where the moisture content or cohesion is known to be suitable, for example, a suitability range for the slope of an initial segment of the compaction response curve may be determined. A heavier compactor machine, or one employing the use of a vibratory mechanism may cause the initial segment of a compaction response curve to be steeper than that of smaller or non-vibratory machines. In other embodiments, rather than a suitability range, a particular slope value could be used as a threshold for determining whether aberrant compaction criteria are met. Stated otherwise, rather than a range, a discrete slope value might be used as a trigger for deciding "aberrant" versus "non-aberrant."

In addition to the aforementioned slope analysis, determining if one or more regions of a work area is aberrant, and hence, whether a compaction response disconformity exists, may further include determining the closeness of fit of sensed compaction state values to the resultant compaction response curve. In one aspect, the sensed values, or other values corresponding with the sensed values, may be compared with corresponding points on a compaction response curve associated with a particular region of the work area. This may include determining a value such as an error of fit of the sensed values relative to the compaction response curve they define, for example, by calculating a sum of errors via known techniques. For ease of description, the term "closeness of fit" is used herein to refer generally to the various quantitative and qualitative techniques that may be used to characterize the relationship between the compaction response curve and the values defining the curve.

While it is contemplated that electronic controller 30 may be configured to determine a compaction response disconformity exists, it is also contemplated that an operator or a technician could simply view a compaction response curve, and compare the compaction response curve to the values defining the curve to determine whether a compaction response for a particular region is aberrant. In other words, the closeness of fit mentioned above might be visually displayed, allowing an operator or technician to monitor compaction and decide whether the compaction response associated with a particular region is aberrant, and also whether a compaction response disconformity exists by comparing the compaction response curve for one region with another.

Determining whether the compaction response associated with a particular region is aberrant may also include predicting a number of compactor passes necessary to reach a target compaction state. If the predicted number of passes is above a desired number of passes, for example twenty passes, it may be determined that the region is aberrant and a compaction response disconformity exists, if at least one region of the work area is not aberrant, or is aberrant for different reasons. Work material having excess moisture content has been found to typically exhibit a fairly high closeness of fit of its compaction response curve, and thus may not immediately appear to exhibit an aberrant compaction response.

It has been found, however, that the compaction response curve for excess moisture conditions tends to approach an asymptotic level of energy prior to reaching a target compaction state, at least where the compaction response is load bearing capacity or net energy. A number of compactor passes selected as a threshold for characterizing a particular region as aberrant in this instance may be arbitrarily selected, based on operator preferences, or it may be selected based upon simulation or field experience. In other words, an aberrant compaction response may exist where moisture content of the work material is such that reaching target compaction is impossible. Aberrant compaction may also correspond to a number of compactor passes necessary to reach the target compaction state that is simply too high to be practicable.

Relatively poor closeness of fit may indicate an aberrant condition such as an overcompacted state. If the work material is overcompacted, it may be damaged by successive compactor passes. The work material may become brittle as it increases in density, resulting in failure, loosening or loss of compaction. Thus, if overcompaction is apparent or appears likely, an aberrant compaction response may exist for a particular region of the work area, and hence, a compaction response disconformity, if other regions exhibit different compaction responses.

If the work material is determined to not be overcompacted, but nevertheless has a relatively poor closeness of fit, it may satisfy an unfit aberrant condition. An unfit aberrant condition may be understood as a general provision whereby otherwise unexplained inconsistency or unreliability in the compaction response of the work material suggests an aberrant condition, and possibly an associated compaction response disconformity. An unfit aberrant condition may exist, for example, because of a boulder inadvertently included in the prepared work material, an inappropriate lift thickness for the particular compaction machine or some other confounding factor such as unstable base or overall unsuitable soil type.

Similar to the foregoing discussion of the slope of an initial portion of a compaction response curve, the closeness of fit that serves as the trigger for determining a particular region is aberrant may be determined empirically. An $R^2$ value may be determined, for example, by determining the quotient of the sum of the squared errors (the difference between values corresponding to inputs from sensor 26 and corresponding points on the compaction response curve, squared, then summed) and the sum of the squares total (the difference between the actual sensed values and the average of the actual data points, squared, then summed). This quotient may then be subtracted from the number 1 to give the $R^2$ value. Those skilled in the art will appreciate that a relatively higher $R^2$ value corresponds to a relatively closer fit of the compaction response curve. As alluded to above, it has been discovered that the closeness of fit serves as a means for assisting in determining whether aberrant conditions exist.

To empirically determine a suitable $R^2$ value for the above determination, compaction test beds having known characteristics may be used, and compaction state data collected which correspond with a plurality of compactor passes. Compaction response curves may then be generated which correspond with data points collected for each of the compactor passes, and an $R^2$ value or range considered to distinguish aberrant from non-aberrant conditions may be determined. Similar to slope of the initial part of the compaction response curve, $R^2$ may be used on its own to decide between aberrant and non-aberrant compaction response conditions in certain embodiments.

It has been discovered that work material having near optimum moisture content, and high moisture content work materials, are typified by relatively high $R^2$ regression values. Low cohesion work materials in turn tend to have only moderate $R^2$ values, whereas unfit work materials tend to have relatively low $R^2$ values. Low moisture content work materials may have relatively high $R^2$ values in an initial part of the compaction response curve; however, they may tend to become less well behaved as compaction continues, as mentioned above. Because low moisture content work material may have relatively high $R^2$ values at least initially, initial slope may be used to detect insufficient moisture aberrant conditions. Similarly, because optimum moisture and excess moisture conditions may appear somewhat similar with respect to their $R^2$ values, the number of predicted compactor passes may be used to detect excess moisture aberrant conditions.

It should be appreciated that although the above mathematical approach to evaluating the features of the compaction response curve may provide a relatively rigorous, reliable approach, the present disclosure is not thereby limited. In light of the present disclosure, it will be apparent that generalities may exist for certain work material conditions which may be used to identify when the work material is poorly suited to compaction. Operator or technician discernible irregularities in curve shape from a relatively smooth, consistent compaction response curve may indicate that conditions are aberrant. If aberrant conditions are determined to be associated with one region, and non-aberrant conditions associated with a different region of the work area, then a compaction response disconformity may exist. Similarly, markedly shallow or steep initial slopes of the compaction response curve may indicate a problem. Thus, it is emphasized that mathematically determining slope, error of fit or other features of the curve may not be necessary for a given strategy to fall within the scope of the present disclosure. Electronic control systems as well as operator or technician monitoring may be capable of recognizing problems in the compaction process without performing the illustrative calculations set forth herein. Aberrant conditions, as well as target conditions, may also be detected by comparing compaction response curves with signature equations known to be associated with specific aberrant or target conditions for certain work material types.

Where at least one region of the work area is determined to have an aberrant compaction response, compactor 10 may be moved across the corresponding region(s) of the work area via fewer total passes than regions exhibiting target compaction, eliminating or at least reducing wasted effort. In other embodiments, however, determination of a compaction response disconformity will allow compacting of a first region to be terminated where it has reached a target compaction state, and efforts concentrated on other areas which, while not necessarily aberrant, may need additional compactor passes.

It will generally be necessary to move compactor 10 across each of the regions of a work area via an equal number of preliminary passes such that sufficient compaction state data may be gathered for determining a compaction response associated with each region. At least two, typically three or more compactor passes will be desirable, depending upon the sensitivity and type of compaction state sensing equipment, the type of work material, and the desired accuracy of the compaction response data.

In one practical implementation strategy, compactor position and compaction response will be determined onboard compactor 10 in real time. In other embodiments, however, compaction response and compactor position might be determined by means separate from compactor 10. For instance, a laser-based positioning system might be used to remotely monitor a position of compactor 10, whereas compaction response data could be sensed via sensors of a machine separate from compactor 10. Further, the determination that a compaction response disconformity exists could take place via a remote computer, and appropriate compactor navigation signals transmitted to compactor 10 to autonomously maneuver compactor 10 or to guide an operator.

The method of the present disclosure may further be understood as including maneuvering compactor 10 within a work area responsive to a signal associated with a determined compaction response disconformity between regions, responsive to a determined aberrant compaction response of a region, or responsive to a determined target compaction response of a region. Maneuvering compactor 10 may include outputting steering control signals to steering system 44. In one embodiment, the compactor navigation signal may be an operator perceptible navigation signal such as coloration on a map of the work area, arrows, etc. that can guide an operator as to where compactor 10 is to be steered. In other embodiments, the compactor navigation signal may comprise one or more steering control signals that are outputted to steering system 44 to autonomously guide compactor 10 along a desired compactor travel path, via steering control signals that are separate from outputted steering commands, if any, associated with operator input device 20. In general, steering control signals may be generated by electronic controller 30 responsive to position signals received via receiver 24 and a desired compactor travel path. The desired compactor travel path may be determined based on the compaction responses associated with the respective regions of the work area, for example a compaction response disconformity between at least two of the regions.

Electronic controller 30 may be configured to control maneuvering of compactor 10 within a work area responsive to the received position signals and sensed compaction state data. To this end, electronic controller 30 may include a computer readable medium such as RAM or ROM having a compactor maneuvering control algorithm recorded thereon. The subject control algorithm may include means for generating a compactor navigation signal(s), for instance steering control signals, to guide compactor 10 along a desired travel path responsive to a determined aberrant compaction response of at least one region of a work area, or responsive to a determined compaction response disconformity. The compactor maneuvering control algorithm may further include means for determining a desired compactor travel path within a work area, and means for outputting steering control signals to steering system 44 responsive to the compactor navigation signal. As described above, all of the control operations need not be carried out by electronic controller 30, nor via its associated compactor maneuvering control algorithm, and dedicated hardware might be used to effect certain of its functions rather than purely software based control.

INDUSTRIAL APPLICABILITY

Figure 2:
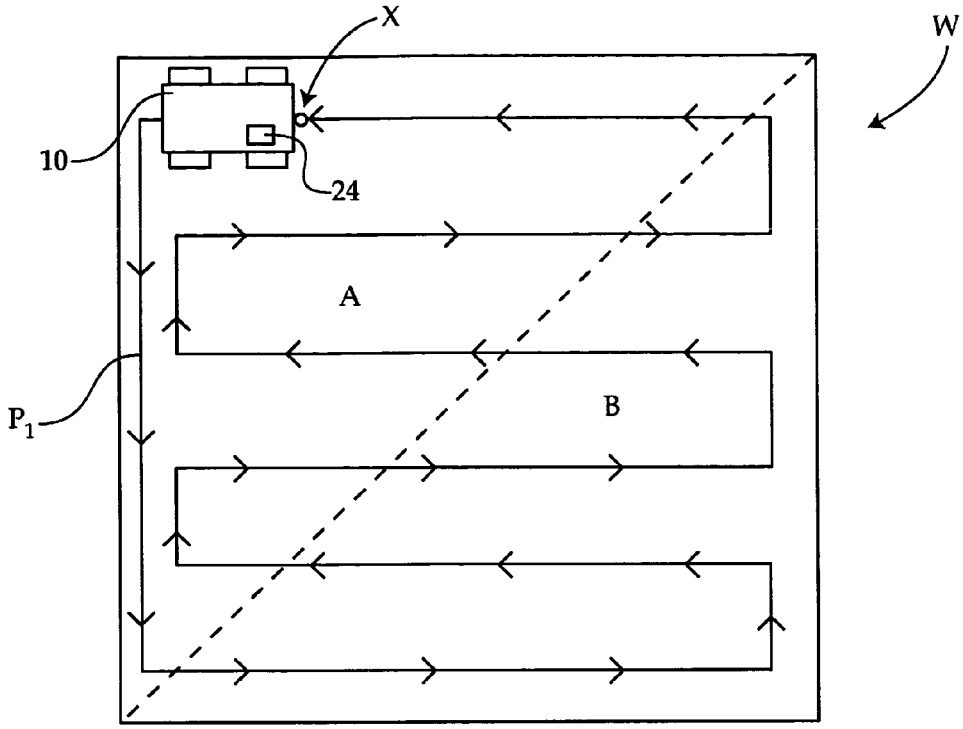
FIG. 2 is a diagrammatic view of a work area having therein a compactor machine similar to the compactor machine of FIG. 1 and shown in relation to a first compactor travel path.

Referring to FIG. 2, there is shown a work area W having a compactor machine 10 therein. Work area W may be understood as having a plurality of separate regions, shown as A and B in FIG. 2. In a typical process according to the present disclosure, compactor 10 may be driven across each of regions A and B via a plurality of passes. An exemplary compactor travel path $P_1$ is shown in FIG. 2 having an origin and a terminus X. Path $P_1$ may be arbitrarily selected, for example by an operator, or it may consist of a predetermined path based on the size and/or shape of work area W. In most instances, path $P_1$ will generally allow compactor 10 to uniformly cover work area W a prescribed number of times and in as short a total path distance as practicable.

Compactor 10 may be steered along path $P_1$ by an operator or by electronic controller 30 such that each of regions A and B is covered a plurality of times, typically via an equal number of preliminary compactor passes. During moving compactor 10 along path $P_1$, relative rolling resistance may be sensed via sensor 26, and position signals received via receiver 24. Electronic controller 30 may further utilize the position and compaction response information to determine a compaction response associated with regions A and B of work area W.

It should be appreciated that work area W need not be conceptualized as having different regions prior to beginning work. It is the determination of a compaction response disconformity that will generally define the separate regions of work area W. Thus, where a compaction response of work area W is found to be non-uniform, it may be determined in at least some instances that a compaction response disconformity exists, defining at least two regions associated with differing compaction responses. Region A, for example, in the embodiment shown in FIG. 2 may be characterized by a target compaction response, requiring further compacting but predicted to eventually reach a target compaction state within a reasonable number of compactor passes, whereas Region B might have an aberrant compaction response. Thus, the difference between compaction responses of Regions A and B may indicate a compaction response disconformity. Where a compaction response disconformity exists, a desired subsequent compactor travel path may be determined which may include regions needing further compaction, such as Region A, and may exclude other regions where additional attempts at compaction will be futile, such as Region B.

Figure 3:
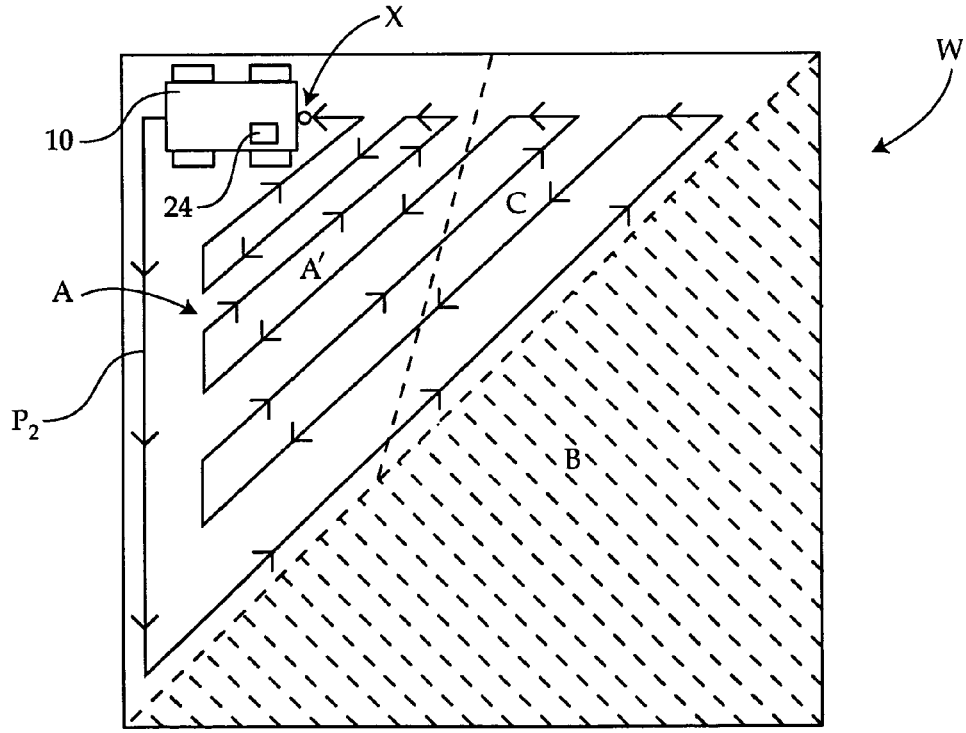
FIG. 3 is a diagrammatic view of the work area shown in FIG. 2, illustrating a different compactor travel path.

Turning to FIG. 3, there is shown worksite W with compactor 10 as it might appear after having traversed a compactor travel path, $P_2$, generated responsive to the compaction response disconformity detected while traversing path $P_1$ shown in FIG. 2. It will be noted that path $P_2$ includes Region A but excludes Region B. In certain embodiments, the origins of different desired travel paths may differ, however, similar or identical origins for the respective paths may be used, as shown with origin X in FIG. 3, where path length can thereby be minimized. Sensed values from sensor 26, as well as position signals received via receiver 24, may be utilized by compactor 10 during or after traversing path $P_2$, to determine compaction responses associated with Region A, and to also determine whether a compaction response disconformity exists within region A. Position signals received with receiver 24 may also be used in generating a compactor navigation signal and associated steering control signals to guide compactor 10 autonomously along an appropriate travel path.

Figure 4:
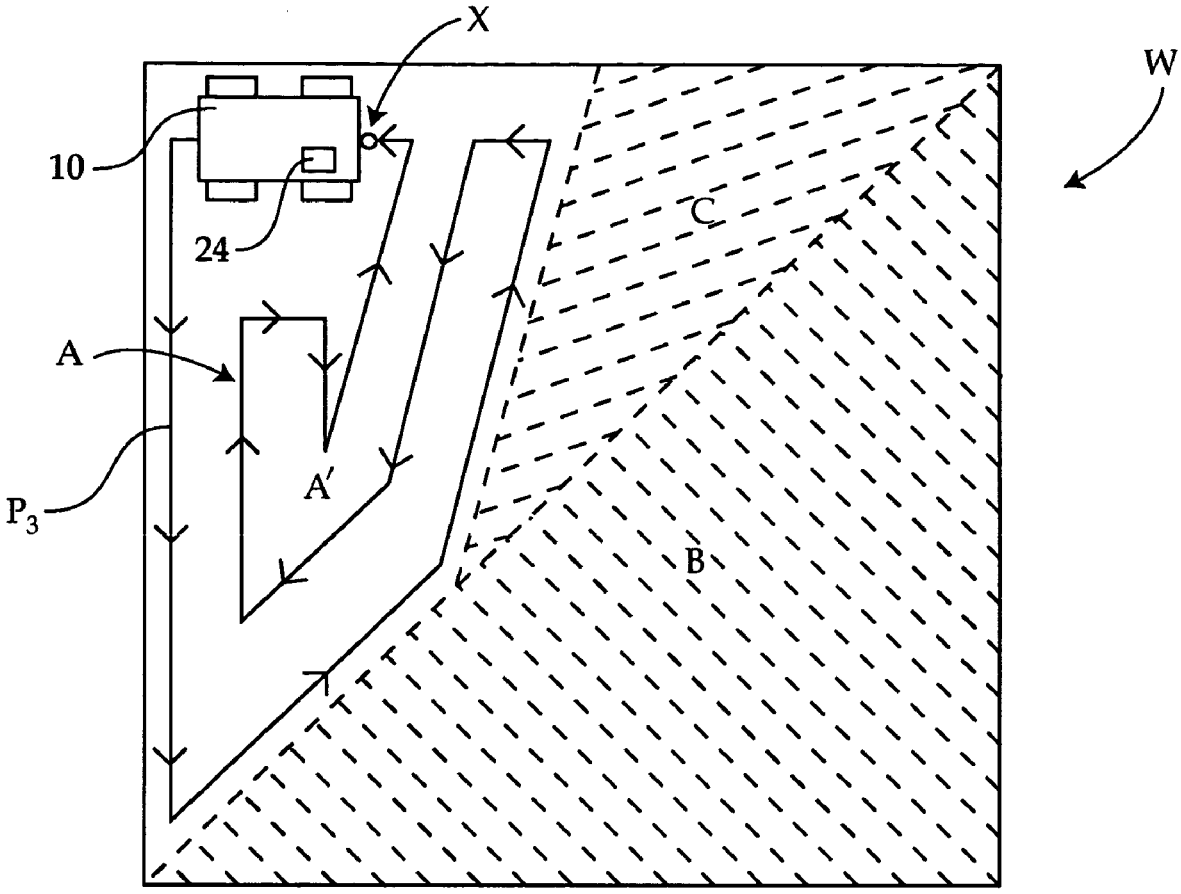
FIG. 4 is a diagrammatic view of the work area shown in FIG. 2, illustrating yet another compactor travel path.

In FIG. 3, Region A has been subdivided to Regions A' and C to represent another compaction response disconformity. The compaction response disconformity represented in FIG. 3 may be the result of revision of the compaction response data for worksite W obtained while traversing path $P_1$. For instance, one of Regions A' and C may have reached a target compaction state, for example, while the other of Regions A' and C needs still further coverage by compactor 10. Alternatively, one of Regions A' and C might be determined to be aberrant after the additional compactor passes associated with path $P_2$, although such an aberrant condition was not detected during the preliminary passes along path $P_1$. Turning to FIG. 4, there is shown worksite W with compactor 10 as it might appear after having traversed yet another desired compactor travel path, $P_3$. In FIG. 4, path $P_3$ may be selected to include Region A', and exclude Region C, for example, because Region C has already reached target compaction and Region A needs still further coverage by compactor 10, or because Region C is determined to be aberrant.

Figure 5:
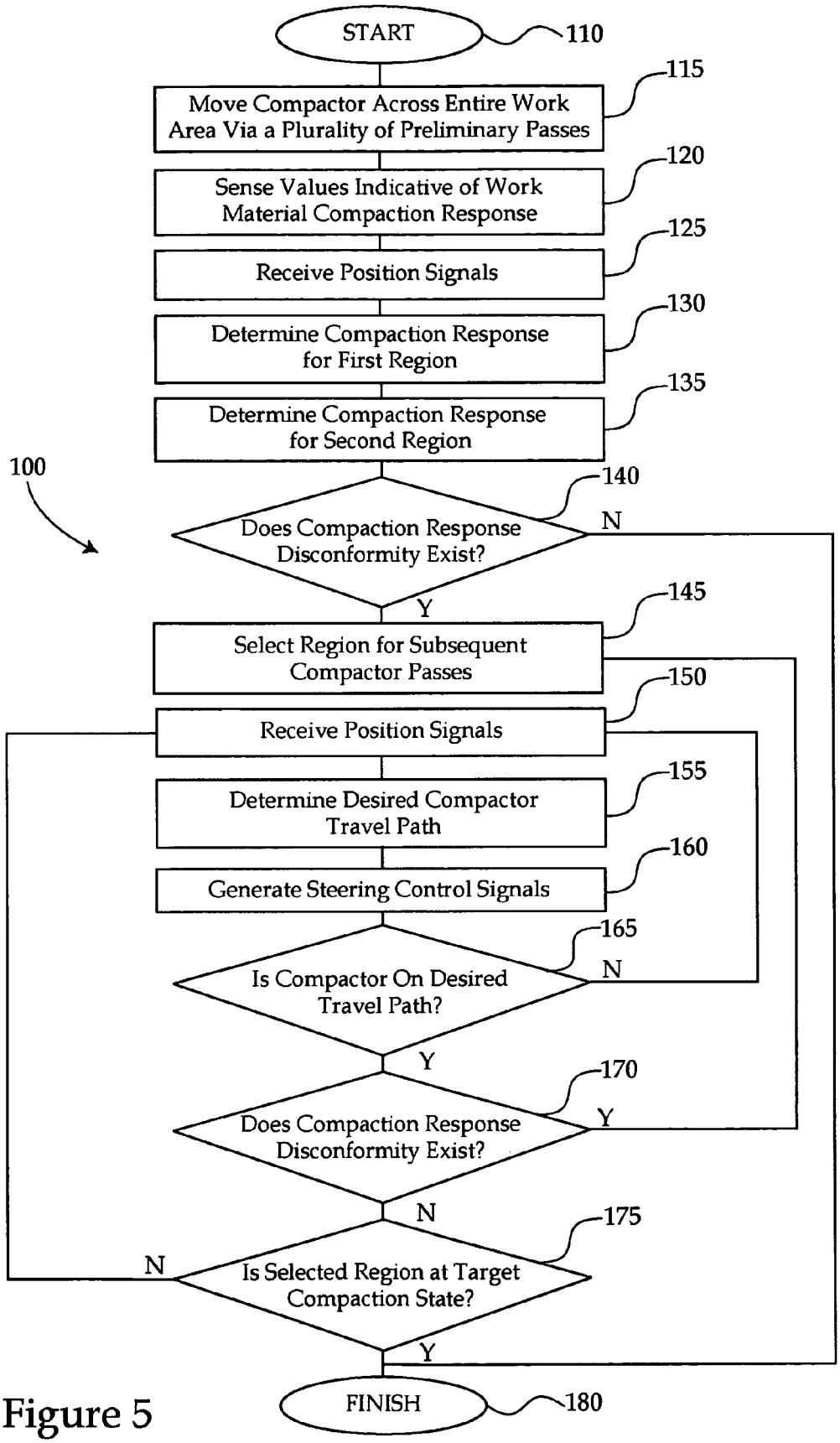
FIG. 5 is a flowchart illustrating a control process according to one embodiment of the present disclosure.

Referring to FIG. 5, there is shown a control process 100 by way of a flowchart. Process 100 may begin at step 110, a start or initialize step, and may thenceforth proceed to step 115 which includes moving compactor 10 across an entire work area such as work area W via a plurality of preliminary passes. From step 115, process 100 may proceed to step 120 wherein values indicative of a work material compaction response will be sensed during moving compactor 10 across the entire work area. From step 120, process 100 may proceed to step 125, receiving position signals, for example via receiver 24, which allows the relative position of compactor 10 within work area W to be determined, as well as allowing sensed values associated with a work material compaction response to be associated with particular regions. It should be appreciated that steps 115, 120 and 125 may take place simultaneously.

From step 125, process 100 may proceed to step 130 which includes determining a compaction response for a first region such as region A shown in FIGS. 2-4. From step 130, process 100 may proceed to step 135 wherein electronic controller 30 may determine a compaction response for a second region, such as region B shown in FIGS. 2-4. As described above, dividing work area W into separate regions may be defined by differing compaction responses, i.e. a compaction response disconformity, in the respective regions. Thus, the present disclosure should not be understood to require that a work area have predetermined regions.

From step 135, process 100 may proceed to step 140 wherein electronic controller 30 may query whether a compaction response disconformity exists. If no compaction response disconformity is detected at step 140, e.g. the compaction response of the entire work area or selected portions thereof is relatively uniform, process 100 may proceed to Finish at step 180. If a compaction response disconformity is determined to exist at step 140, process 100 may proceed to step 145.

At step 145, one or more regions may be selected for subsequent compactor passes. The selected region may include, for example, a region wherein compaction progress is as desired, but which has not yet reached a desired compaction state, such as Region A in FIG. 2. From step 145, process 100 may proceed to step 150 to again determine a relative position of compactor 10 via the receipt of position signals, for example via receiver 24. From step 150, process 100 may proceed to step 155 wherein electronic controller 30 may determine a desired compactor travel path. The desired compactor travel path may include the region(s) selected for subsequent compactor passes, and may exclude regions determined to be inappropriate or undesirable for subsequent compactor passes, such as Region B in FIG. 2. It should be appreciated that selecting one or more regions for subsequent compactor passes could also be achieved via flagging regions that are not suitable, in other words, de-selecting regions for subsequent compactor passes rather than selecting regions for the subsequent passes. A desired compactor travel path will often be the shortest path which will allow compactor 10 to pass over the subject region(s) a desired number of times, although the present disclosure is not thereby limited.

From step 155, process 100 may proceed to step 160 wherein electronic controller 30 will output a compactor navigation signal, including for example steering control signals, while moving compactor 10 within a selected region(s) of work area W as per step 145. During moving compactor 10 within work area W to achieve a desired number of subsequent compactor passes, values may be sensed which are indicative of compaction response and a compaction response determined for the selected region(s), similar to steps 120-135. As described herein, the steering control signals generated in step 160 might be actuation signals to steering system 44, or they might be directives or suggestions to an operator, for example, arrows identifying a desired travel direction on a display screen, or warning lights activated when compactor 10 departs from a desired travel path.

From step 160, process 100 may proceed to step 165 wherein electronic controller 30 may verify whether compactor 10 is on a desired travel path, for example, by comparing a determined position of compactor 10 with a desired position via comparing received position signals with desired position signals corresponding to a particular location of compactor 10. If no, process 100 may return to step 150 to again determine a relative position of compactor 10, a desired travel path, and output steering control signals to again reach step 165.

It should further be appreciated that the determination of whether compactor 10 is on a desired travel path may also include determining whether compactor 10 has completed traversing a desired travel path. In other words, the determination in step 165 might also be understood as a query whether compactor 10 has completed a desired travel path a desired number of times, which will correspond to a desired number of subsequent compactor passes.

If at step 165 compactor 10 is on a desired travel path and/or has completed traversing a desired travel path a desired number of times, process 100 may proceed to step 170 where electronic controller 30 may again query whether a compaction response disconformity exists. In step 170, the determination of whether a compaction response disconformity exists may include a comparison of determined compaction responses for regions A' and C as shown in FIG. 3, for example. If a compaction response disconformity is determined to exist at step 170, process 100 may return to step 145 to select one of the now defined regions A' or C for subsequent compactor passes. If at step 170, no compaction response disconformity is determined to exist, process 100 may proceed to step 175 wherein electronic controller 30 may query whether a selected region is at a target compaction state. If at step 175 the answer is no, process 100 may return to step 150 to receive position signals, and again plot a desired compactor travel path and follow the same, again via steps 150 to 170. If the selected region is determined to be at a target compaction state in step 175, process 100 may proceed to step 180 to Finish.

Returning in particular to FIGS. 2-4, it may be noted that rather than uniformly covering work area W, the work area is divided and subdivided in a way that will allow compactor 10 to non-uniformly move about the work area via travel paths which include only those regions of work area W where compactor work is appropriate. The present disclosure will thus allow guiding of compacting machinery such as compactor 10 to avoid unnecessary passes over certain regions of a work area. This strategy will reduce the total distances traveled by compactor 10 during compacting a work area, and will reduce fuel consumption, operator time and wear and tear on machinery that results from unnecessary work. Moreover, the present disclosure further provides a system for compacting that may be fully autonomous, yet still account for variations in compaction response between different regions of a work area.

In either a fully autonomous or operator controlled embodiment, recognition of a compaction response disconformity will allow an action to be taken to avoid unnecessary or undesired work in instances where earlier designs would provide no guidance. In other words, because the present disclosure contemplates detecting a disconformity with electronic controller 30, or one or more other controllers, operator perception is not necessary to reach the conclusion that compactor navigation should account for regions already satisfactorily compacted, or regions not responding properly to compaction.

The present description is for illustrative purposes only and should not be construed to narrow the breadth of the present disclosure in any way. Thus, those skilled in the art will appreciate that various modifications might be made to the presently disclosed embodiments without departing from the intended spirit and scope of the present disclosure. For instance, while it is contemplated that in some embodiments, regions of a work area will simply be avoided by compactor 10 when they are discovered to be aberrant, additional steps might be taken responsive to a determined aberrant condition and/or compaction response disconformity. For example, in FIGS. 3 and 4, compactor 10 is shown having traveled in such a manner so as to avoid regions not suitable for or not needing further compactor coverage. While compactor 10 is covering regions appropriate for compaction, moisture adjusting equipment such as a water truck or disc-equipped tractor might be dispatched to regions avoided by compactor 10, so that compactor 10 can later return to complete compacting work when moisture remediation is complete. Other aspects, features and advantages will be apparent upon an examination of the attached drawings and appended claims.

What is claimed is:

1. A method of operating a compactor machine comprising the steps of:

moving the compactor machine within a work area;

determining a work material compaction response disconformity exists between at least two regions of the work area;

generating a compactor navigation signal responsive to the compaction response disconformity; and wherein generating a compactor navigation signal includes commanding imparting a different net compaction energy with the compactor machine to a first one of the at least two regions than to a second one of the at least two regions.

2. The method of claim 1 further comprising a step of determining a desired compactor travel path within the work area responsive to the compaction response disconformity, wherein the generating step further comprises generating a compactor navigation signal corresponding with the desired compactor travel path.

3. The method of claim 2 further comprising a step of receiving position signals associated with a relative position of the compactor machine within the work area, wherein the determining step comprises determining a work material compaction response disconformity exists based at least in part on, the position signals, and sensor inputs indicative of work material compaction state from at least one sensor of the compactor machine.

4. The method of claim 3 wherein the step of receiving position signals comprises receiving signals indicative of a relative elevation of the compactor machine.

5. The method of claim 3 wherein the generating step comprises generating steering control signals responsive to the position signals and the desired compactor travel path, and wherein the moving step further comprises a step of maneuvering the compactor machine within the work area via the steering control signals.

6. The method of claim 5 wherein the step of determining a compaction response disconformity exists comprises the steps of determining at least one region of the work area is associated with a target compaction response, and at least one other region of the work area is associated with an aberrant compaction response.

7. The method of claim 6 wherein the at least one region associated with a target compaction response includes a first region and the at least one region associated with an aberrant compaction response includes a second, different region, and wherein the step of moving the compactor machine further comprises the steps of moving the compactor machine across the first region via a first number of compactor passes, and moving the compactor machine across the second region via a second, different number of compactor passes.

8. The method of claim 5 wherein the compactor machine includes an operator input device configured to output steering commands to a steering system of the compactor machine, and wherein the step of maneuvering the compactor machine includes maneuvering the compactor machine via the steering control signals that are separate steering commands associated with the input device.

9. A method of compacting a work area with a compactor machine comprising the steps of:

sensing values indicative of a work material compaction response in a first region of the work area;

sensing values indicative of a work material compaction response in at least one other region of the work area;

determining a work material compaction response in the at least one other region of the work area is an aberrant compaction response; and maneuvering the compactor machine to impart a different net compaction energy to the first region than to the second region within the work area responsive to a signal associated with the aberrant compaction response.

10. The method of claim 9 further comprising the steps of receiving position signals associated with a relative position of the compactor machine within the work area, and generating a compactor navigation signal responsive to the aberrant compaction response and the position signals, wherein the maneuvering step comprises maneuvering the compactor machine responsive to the compactor navigation signal.

11. The method of claim 10 further comprising a step of determining a desired compactor travel path within the work area responsive to the aberrant compaction response, wherein the step of generating a compactor navigation signal comprises a step of generating steering control signals, and wherein the maneuvering step includes maneuvering the compactor machine according to the desired travel path responsive to the steering control signals.

12. The method of claim 11 wherein the step of determining a work material compaction response in the at least one other region is an aberrant compaction response comprises a step of determining a compaction response curve associated with the at least one other region.

13. The method of claim 12 wherein the step of determining a work material compaction response associated with the at least one other region is an aberrant compaction response includes determining a compaction response of the at least one other region is associated with one of, an aberrant moisture, an inappropriate lift thickness, an overcompacted and an unfit condition.

14. The method of claim 10 wherein:

the moving step includes moving the compactor machine across each of a plurality of regions of the work area via an equal number of preliminary passes, and moving the compactor machine across at least one of the regions via a plurality of subsequent passes;

the step of determining a desired compactor travel path includes determining a desired compactor travel path for the plurality of subsequent passes which includes the first region and excludes the at least one other region; and the maneuvering step includes maneuvering the compactor machine during the plurality of subsequent passes via steering control signals corresponding with the compactor navigation signal.

15. A system for compacting a work area comprising:

a compactor machine;

at least one sensor configured to sense values indicative of a work material compaction response within a work area; and an electronic controller coupled with said at least one sensor and configured via a compactor maneuvering control algorithm to detect an aberrant work material compaction response in a region of the work area and generate a compactor navigation signal which is based at least in part on planned imparting of different net compaction energy with the compactor machine to a first region of the work area than to a second region of the work area responsive to the aberrant work material compaction response.

16. The system of claim 15 wherein the at least one sensor includes a sensor mounted on the compactor machine.

17. The system of claim 16 wherein said compactor machine further includes a receiver configured to receive position signals indicative of a relative position of said compactor machine within said work area, and a steering system, and wherein said control algorithm includes means for determining a desired compactor travel path within said work area and means for outputting steering control signals to said steering system, responsive to said compactor navigation signal and said position signals.

18. The system of claim 17 wherein said electronic controller is further configured via said control algorithm to determine whether a compaction response disconformity exists between the region having an aberrant compaction response and at least one other region of the work area and to generate said compactor navigation signal responsive to a determined compaction response disconformity.

* * * * *